United States Patent [19]

Zerga

[11] 4,205,610

[45] Jun. 3, 1980

[54] SHALE OIL RECOVERY PROCESS

[75] Inventor: Daniel P. Zerga, Concord, Calif.

[73] Assignee: Geokinetics Inc., Concord, Calif.

[21] Appl. No.: 895,243

[22] Filed: Apr. 10, 1978

[51] Int. Cl.[2] ..... F42D 1/00

[52] U.S. Cl. ..... 102/23; 166/259

[58] Field of Search ..... 102/22, 23; 166/299, 166/259; 299/13

[56] References Cited

U.S. PATENT DOCUMENTS

| | | | |
|---|---|---|---|
| 1,195,781 | 8/1916 | Clark | 299/13 |
| 2,239,123 | 4/1941 | Stoneking | 102/23 |
| 3,466,094 | 9/1969 | Haworth et al. | 102/23 |
| 3,674,089 | 7/1972 | Moore | 166/299 |
| 3,863,987 | 2/1975 | Lampard | 102/23 |
| 3,902,422 | 9/1975 | Coursen | 102/23 |
| 3,973,497 | 8/1976 | Coursen | 102/23 |
| 4,015,664 | 4/1977 | Acheson et al. | 102/23 |
| 4,045,085 | 8/1977 | Garrett | 299/13 |

*Primary Examiner*—David H. Brown

*Attorney, Agent, or Firm*—Warren, Chickering & Grunewald

[57] ABSTRACT

A process of producing within a subterranean oil shale deposit a retort chamber containing permeable fragmented material wherein a series of explosive charges are emplaced in the deposit in a particular configuration comprising an initiating round which functions to produce an upward flexure of the overburden and to initiate fragmentation of the oil shale within the area of the retort chamber to be formed, the initiating round being followed in a predetermined time sequence by retreating lines of emplaced charges developing further fragmentation within the retort zone and continued lateral upward flexure of the overburden. The initiating round is characterized by a plurality of 5-spot patterns and the retreating lines of charges are positioned and fired along zigzag lines generally forming retreating rows of W's. Particular time delays in the firing of successive charges are disclosed.

13 Claims, 6 Drawing Figures

Fig. 3
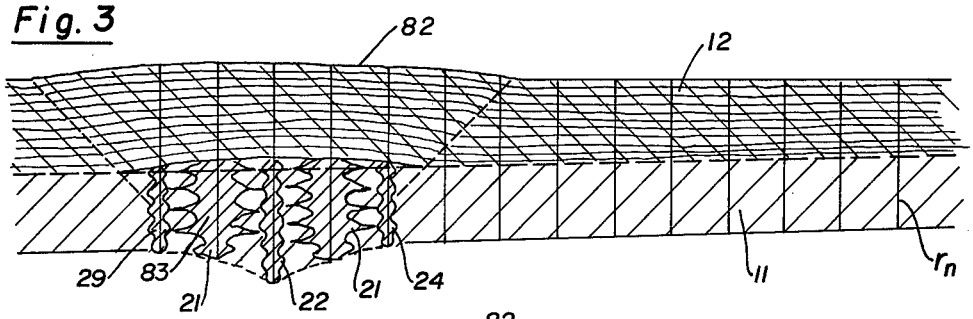
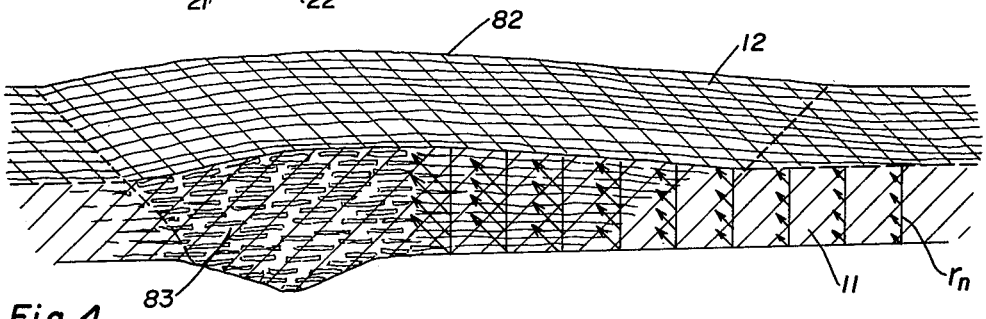
Fig. 4
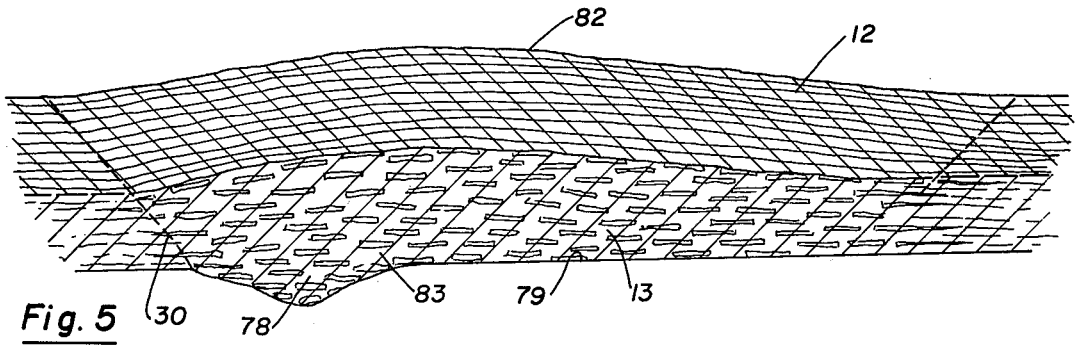
Fig. 5
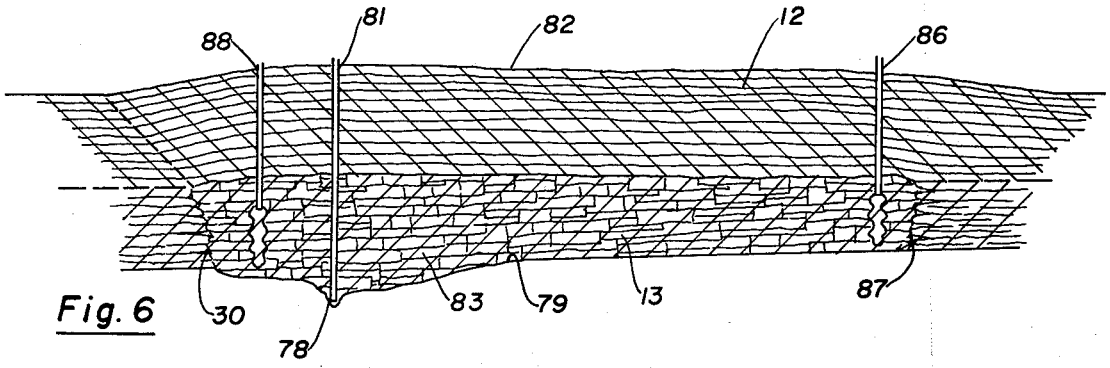
Fig. 6

SHALE OIL RECOVERY PROCESS

BACKGROUND OF THE INVENTION

1. Field of the Invention

The invention relates to processes for producing an underground zone of fragmented and pervious material which may be used as a storage area, as a passage or aquifer, for treatment of materials, for ore body leaching or recovery of carbonaceous materials from subterranean deposits, etc. It has particular value in the extraction of oil and hydrocarbon gases from subterranean oil shale deposits by in situ retorting.

2. Description of Prior Art

As is well known, very large amounts of hydrocarbon oil are contained in subterranean oil shale deposits and the economic recovery of such oil and/or hydrocarbon gases has been a long-sought-after objective. Access to the oil shale may be obtained by removing the overburden by a strip mining procedure. However, such procedure is both costly and deleterious to the terrain. Efforts have, accordingly, been made to extract the oil and valuable hydrocarbon gases by the production of subterranean retorts in the oil shale deposits with minimum disturbance of the land surface. An example of such a procedure is disclosed in U.S. Pat. No. 4,037,657.

Heretofore, in the firing of charges emplaced in the subterranean ore body some lifting of the overburden has been accomplished to provide an in situ retort chamber. It is difficult, however, to effect such raising of the overburden without the production of substantial cracks which need to be sealed in order to provide an effective lid for the retort chamber. Another and effective technique is to sever a block of overburden by defining planes of discontinuity peripherally around the block. Such planes may be present by reason of local jointing or they may be produced by explosive fracturing, i.e., pre-splitting. An initiating round of explosive charges may then be used to raise the block, and this may be followed by the firing of adjacent charges in the deposit to effect fragmentation and further raising of the overburden.

SUMMARY OF THE INVENTION

I have found that, by the placement of a series of explosive changes in the subterranean oil shale deposit in a particular configuration, it is possible to produce an upper flexure of the overburden and to initiate fragmentation of the oil shale within the area of the retort chamber to be formed, and that this may be accomplished efficiently without requiring an initial severing of a block of the overburden and without the introduction of seriously disabling cracks in the overburden. In accordance with the present invention, the initiating round is followed in a predetermined time sequence by retreating lines of emplaced charges, developing further fragmentation within the retort zone, enlarging the retort chamber, and providing continued lateral upward flexure of the overburden.

Normally, the overburden comprises a lower grade oil shale ranging from, say, about 5 to about 15 gallons per ton. This material behaves plastically when stressed to allow significant flexure with minimum rupturing or other impairment of its integrity. It is, accordingly, an object of the present invention to provide a shale oil recovery process of the character described in which an initiating round of explosives is emplaced in the subterranean high grade oil shale deposit in a particular configuration, producing, when fired, upward flexure of the overburden within the limits of rupture and then firing sequentially rows of charges emplaced in the deposit to develop further fragmentation and enlargement of the retort chamber and continued lateral upward flexure of the overburden. The concept is to fire the retreating rows of charges in the direction of the initiating round so as to prop up the overburden and to minimize its recoil, i.e., settling back, to thus provide an effective closed lid for the retort chamber. The initiating round thus starts the flexure of the overburden, which is continued by the retreating rows of charges as a wave action over the length of the retort being developed. In attaining the objective of the present invention, i.e., the upward flexing of the overburden without rupture, the wasteful escape of the explosively generated gases is obviated, and the explosive energy is utilized in the desired retort zone, where the retained gas energy is available for creation of additional fractures, particularly in a horizontal pattern, and the maintenance of the elevating gaseous pressure.

The method of the present invention for creating a retort is thus two-fold, and comprises:

(1) the firing of an initiating round which flexes the overburden and creates a rubble-ized free face at retort depth, and sequentially, (2) firing to the free face thus formed a series of retreating jagged rows moving sequentially away from the initiating round.

The initiating round is characterized by a plurality of 5-spot patterns and the retreating lines of charges are positioned and fired along zigzag lines generally forming retreating rows of W's. Particular time delays in the firing of successive charges, as hereinafter disclosed, beneficially assist in the accomplishment of the objectives of the present invention.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 3 is a vertical cross-sectional view similar to FIG. 2, but showing the action of the initiating round of explosives.

FIG. 4 is a view similar to FIG. 3, but showing a further development of the process.

FIG. 5 is a vertical cross-sectional view similar to FIG. 4 and showing the completed retort chamber.

FIG. 6 is a vertical sectional view similar to FIG. 5, with the retort chamber fitted out for retorting the fragmented material therein.

DETAILED DESCRIPTION OF THE INVENTION

Figure 1:
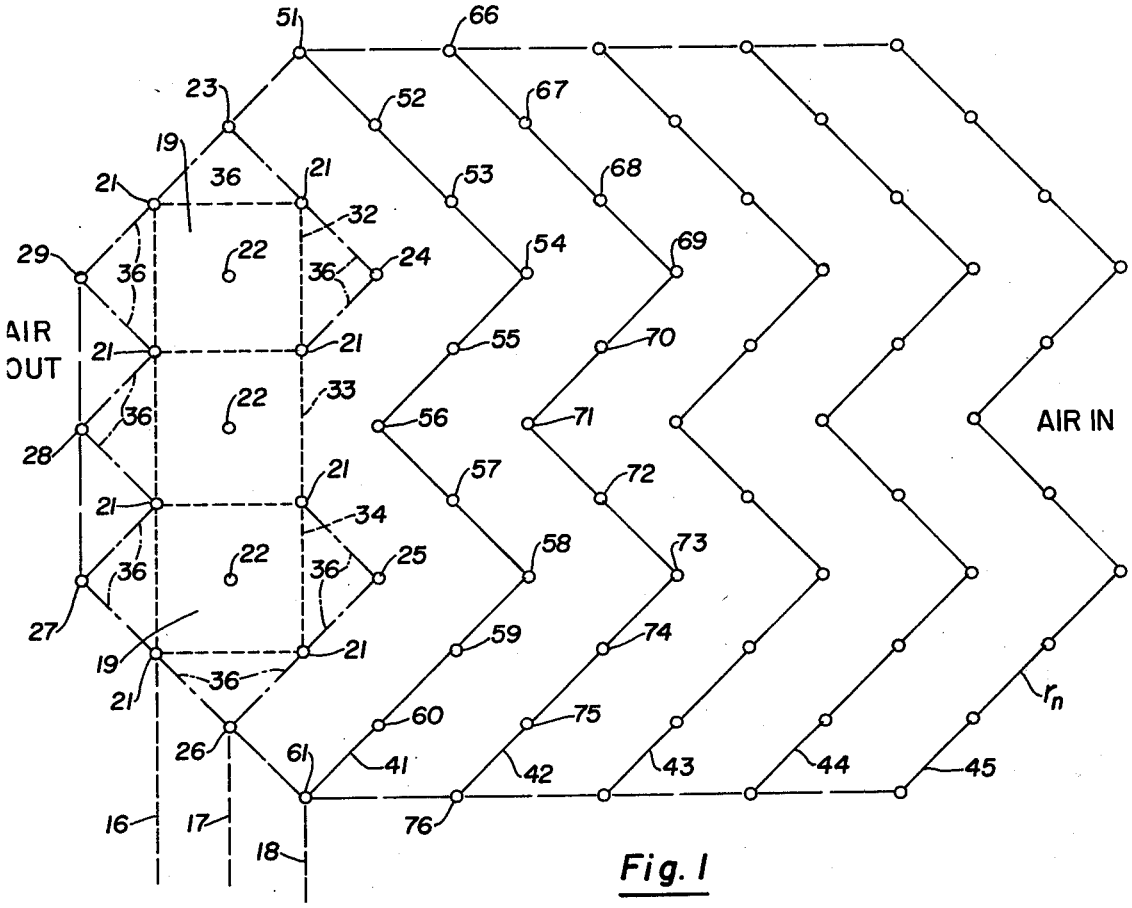
FIG. 1 is a plan view of a pattern of blast holed deployed in accordance with the present invention for emplacing explosive charges in a subterranean high grade oil shale deposit.

The process of the present invention is particularly designed for extraction of oil and hydrocarbon gases from subterranean high grade oil shale deposits 11, and accomplishes this result by effecting an upward flexing of the overburden 12 and the explosive fragmenting of the high grade deposit within a retort chamber 13 defined below the raised overburden. The process comprises, briefly, the placing in deposit 12 of an initiating round of explosive charges disposed in a plurality of at least three substantially parallel rows 16, 17 and 18, with the charges in one row staggered from the charges in an adjacent row and defining a plurality of 5-spot patterns characterized by a plurality of corner charges 21 located at the corners of a plurality of rectangles, see dash lines in FIG. 1, and a plurality of inside charges 22 located within the rectangles; substantially simultaneously firing corner charges 21; and after a predetermined time delay, firing substantially simultaneously the inside charges 22, see FIG. 3. Preferably, all of the charges 21 and 22 are substantially equally spaced from each other with the inside charges 22 positioned at substantially equal diagonal distances from corner charges 21.

Normally, it is considered in blasting practice not feasible, or at least inefficient, to simply drill blast holes through the overburden and into the shale deposit, place explosive charges in the deposit and explode the charges, since it is considered essential in good practice to blast, not merely in solid material, but to a free face. Normally, in the absence of such a free face, the load necessary to cause significant breakage will destruct the surface disadvantageously to subsequent retorting. The process of the present invention, however, successfully and efficiently accomplishes the objective sought, i.e., the raising of the overburden and the production of fragmentation in the deposit against which subsequent blasting may proceed by the use of the unique pattern and firing sequence of the initiating round. The firing of each of the charges in the outside corners of the pattern sets up circular pressure waves moving upward and outward toward the surface, i.e., tending to blast a cone to the surface. The firing of the center shots sets up similar circular waves which intersect the outside waves to produce fragmentation of the central area of each of the 5-spot patterns. A time delay of about 0.3 to 2.5 milliseconds per foot of separation between the inside and corner charges may be used, with an optimal result being obtained with a time delay of about 0.5 to 1.5 milliseconds per foot of burden.

Figure 2:
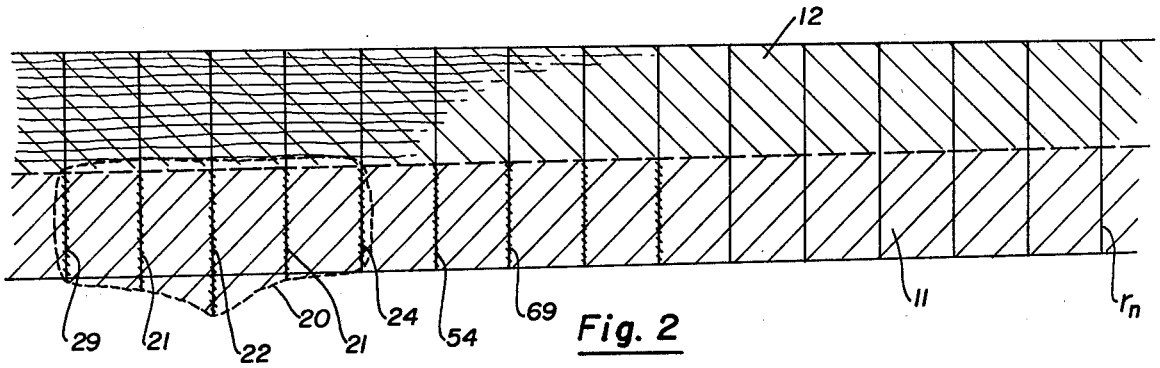
FIG. 2 is a vertical sectional view of the array of blast holes illustrated in FIG. 1.

As part of the initiating round, as generally delineated by the envelope line 20 in FIG. 2, additional charges 23, 24, 25, 26, 27, 28 and 29 are emplaced in the deposit to the outside of the rectangles 32, 33 and 34 defined by corner charges 21, and preferably, these outside charges 23–29 are positioned at the apexes of convergent lines 36 extending from corner charges 21. Of particular significance in the present pattern are charges 24 and 25, which are aligned in a row to the outside of the rectangles and provide a zigzag line at the periphery of the initiating round at the side of the round facing in the direction of subsequent enlargement of the blasting area and retort chamber. Charges 27, 28 and 29 are here positioned in a row to the opposite side of the initiating round and may define one end 30 of the retort chamber being formed. Charges 23 and 26 are here positioned at the opposite ends of the initiating round for enlarging the blasting area in a width-wise direction. Preferably, charges 24 and 25 and 27–29 are positioned transversely opposite inside charges 22 and all of the charges 23–29 are positioned at substantially equally diagonal distances from adjacent pairs of the corner charges. Preferably, charges 23–29 are fired simultaneously with inside charges 22.

In accordance with the present invention, development of the blasting area and retort zones proceeds sequentially along a series of zigzag lines 41, 42, 43, 44 and 45 spaced to the outside of charges 23–26. Line 41 has an apex at bore hole and charge 56, which is midway between charges 24 and 25, and as will be observed from FIG. 1 each of lines 41–45 defines a W form, with the lines retreating in uniformly spaced relation away from the initiating round and in the direction of enlargement of the retort chamber. The first line 41 outside of the initiating round contains charges 51, 52, 53, 54, 55, 56, 57, 58, 59, 60 and 61, and these charges are, preferably, fired simultaneously at some point in time following the firing of charges 23–29, the latter functioning to provide a free face against which charges 51–61 are fired. Preferably, in order to provide continued lateral upward flexure of the overburden started by the initiating round, charges 51–61 in the first row of W's are fired after a predetermined time delay following the firing of charges 23–29. A somewhat larger time delay is used than within the initiating round itself. I have found that a delay of about 3 to 20 milliseconds per foot of burden will provide satisfactory and desired results, burden here being considered to be the distance between charges 51–61 and charges 21 and 23–26.

Charges 66, 67, 68, 69, 70, 71, 72, 73, 74, 75 and 76 lying on the next retreating row are preferably fired simultaneously after a predetermined time delay following the firing of charges in row 41. A time delay of about 0.3 to 2.5 milliseconds per foot of burden between rows 41 and 42 has been found satisfactory and desirable for accomplishing the purposes of the present invention. In a similar manner, the charges in rows 43, 44, and 45 are fired sequentially, with the charges in each row being preferably fired simultaneously and after a predetermined time delay following the firing of the charges in the preceding row. This sequential firing of the rows of retreating W's may be carried out to row $r_n$ using the aforementioned time delay of about 0.3 to 2.5 milliseconds per foot of burden between the firing of the charges in each succeeding row.

As a further feature of the present invention, the charges in the initiating round are preferably positioned to provide a sump 78 or low point in the retort chamber so as to accumulate oil flowing over the floor 79 of the retort chamber being formed for subsequent pumping out via discharge conduit 81, see FIG. 6. This is here accomplished by emplacing certain of the charges in the initiating round, here charges 22 and 23 and 26, at a depth in the deposit lower than the emplacement of the balance of the charges. The action of the sequential firing of the above-described charges in the development of the retort chamber is depicted in FIGS. 3–5. Firing of the initiating round will produce an upward flexing of the overburden, as seen at 82 in FIG. 3, and a fragmenting of the material within the deposit, as seen at 83. In the firing of the 5-spot patterns comprising the initiating round, cracks opened by the firing of the first charges provide transient free faces against which the second charges are blasted. Accordingly, the initiating round is accomplished with efficiency and effectiveness in producing fragmented material 83 and gaseous pressure for raising the overburden, as seen at 82, thereby creating void space for the fragmented material and the retort zone. The displacement and distribution of the fragmented material into this void space provides the necessary permeability for air flow through the retort chamber. The firing of the subsequent rows of retreating W's, as depicted in FIG. 4, will force rubble and gas toward the free faces sequentially provided, thus boosting the overburden up, wedging it up, so to speak, so that its recoil is minimized. In this fashion, fragmentation of the oil shale to be retorted proceeds by sequentially detonating adjacent rows of blast holes and, at the same time, raising the overburden, which, as above noted, provides the desired void space necessary for permeability and burning of the retort. Permeability is also assisted by the production of horizontal fractures created in the final stages of the explosive action when the generated gases seek paths of escape. Paths of least resistance are found along the bedding planes within the rubble zones where horizontal fracturing has already been initiated. Fragmentation is also greatly assisted in the present instance by the use of the W-shaped rows rather than straight rows, so that the breakage interaction of the individual holes creates a more rubble-ized area, rather than the forming of larger size blocks of material.

While the pattern herein depicted is considered typical, adjustments in the powder factor may be made, depending on the thickness of the overburden in the region of the initiating round. This may be accomplished by altering one, two or three of the following determining variables:

(1) the area of the initiating round, (2) blast hole diameters, (3) spacing between blast holes.

The essential thing is to properly flex the initiating round overburden and, at the same time, creat rubble-ization within the retort zone.

The design of the retort zone 13 is such as to provide air communication from one end to the other. Permeability within the retort chamber must be greater than the permeability of the overburden. A typical retort structure is illustrated in FIG. 6, wherein an air inlet conduit 86 is mounted adjacent one end 87 of the retort chamber and air discharge conduit 88 is inserted into the retort chamber adjacent the opposite, initiating, end 30 of the retort chamber. Ignition of the fragmented material is effected adjacent end 87 and the burning will proceed in the direction of end 30, causing entrapped oil to flow out of the fragmented material and onto and over the floor 79 to sump 78, from where it may be pumped out via conduit 81. Products of combustion and other hydrocarbon gases are withdrawn from conduit 88.

While the foregoing process has been described in connection with the recovery of oil from oil shale and for which it is particularly adapted, the process may be used in other situations where it is desired to raise an overburden in order to provide a permeable zone of fragmented material within an ore deposit and wherein the overburden behaves plastically when stressed, as by explosive forces and gases, permitting upward flexure of the overburden with minimum cracking, rupturing or other impairment of its integrity.

What is claimed is:

1. A process of producing a raised overburden and, therebelow and within a subterranean ore deposit, a chamber containing permeable fragmented material, in situations where said overburden behaves plastically when stressed, and comprising:

emplacing in said deposit an initiating round of explosive charges disposed when viewed in plan in a plurality of at least three substantially parallel rows with the charges in one row staggered from the charges in an adjacent row and defining a plurality of 5-spot patterns characterized by a plurality of corner charges located at the corners of a plurality of rectangles and a plurality of inside charges located substantially centrally within said rectangles;

substantially simultaneously firing said corner charges; and after a predetermined time delay firing substantially simultaneously said inside charges.

2. The process of claim 1, emplacing a plurality of third charges in said deposit in a row spaced to the outside of said rectangles and substantially parallel to one row of said corner charges, said third charges being positioned at apexes of convergent lines extending from certain of said corner charges; and firing said third charges substantially simultaneously with said inside charges.

3. The process of claim 2, said time delay comprising about 0.3 to 2.5 milliseconds per foot of separation between said inside and corner charges.

4. The process of claim 3, said time delay comprising about 0.5 to 1.5 milliseconds per foot of separation between said inside and corner charges.

5. The process of claim 2, said inside and corner charges being substantially equally spaced from each other with said inside charges positioned at substantially equal diagonal distances from adjacent pairs of said corner charges.

6. The process of claim 5, emplacing in said deposit a plurality of fourth charges along a zigzag line spaced to the outside of said third charges and having an apex between said third charges, said zigzag line defining a W form spaced substantially uniformly from lines connecting said first and third charges; and firing said fourth charges substantially simultaneously and after the firing of said third charges.

7. The process of claim 6, firing said fourth charges after a predetermined time delay following the firing of said third charges, said last-named time delay comprising about 3 to 20 milliseconds per foot of separation between said corner and fourth charges.

8. The process of claim 6, emplacing a plurality of additional charges in said deposit outside said fourth charges and in positions defining therewith rows of retreating W's comprising $r_1, r_2, \ldots r_n$; and firing said additional charges with the charges in row $r_1$ fired substantially simultaneously followed with a predetermined time delay with the substantially simultaneous firing of charges in row $r_2$ and followed in similar sequence for the balance of the retreating rows out to $r_n$.

9. The process of claim 8, said last-named time delay comprising about 0.3 to 2.5 milliseconds per foot of separation between said rows $r_1 \ldots r_n$.

10. A process of producing a raised overburden and therebelow and within a subterranean oil shale deposit, a retort chamber containing permeable fragmented material comprising:

emplacing in said deposit an initiating round of explosive charges positioned around an initial area to be fragmented, said area having a zigzag side, and a plurality of charges positioned within said area;

emplacing a plurality of additional charges in said deposit exteriorly of said area and in spaced opposed relation to said side, said additional charges being positioned in W-shaped rows retreating from said side;

firing said initiating round; and firing said additional charges with a predetermined time delay following the firing of said initiating round and with a time delay in the firing of charges in said retreating rows.

11. The process of claim 10, the charges within said area being emplaced to a depth in said deposit lower than the emplacement of said corner, third, fourth and additional charges.

12. A process of producing a raised overburden and, therebelow and within a subterranean ore deposit, a chamber containing permeable fragmented material, in situations where said overburden behaves plastically when stressed, comprising:

emplacing in said deposit an initiated round of explosive charges disposed when viewed in plan in a plurality of horizontally spaced rows with the charges in one row staggered from the charges in an adjacent row and in a pattern having peripherally disposed charges defining a zigzag line of W form;

emplacing a plurality of additional charges in said deposit outside said peripherally disposed charges and in positions defining therewith rows of retreating W's comprising rows $r_1, r_2, \ldots r_n$; and firing said first-named charges and thereafter firing said additional charges with the charges in row $r_1$ fired substantially simultaneously followed with a predetermined time delay with the substantially simultaneous firing of charges in row $r_2$ and followed in similar sequence for the balance of the retreating rows out to $r_n$.

13. The process of claim 12, said predetermined time delay comprising about 0.3 to 2.5 milliseconds per foot of separation between said rows $r_1 \ldots r_n$.

* * * * *

UNITED STATES PATENT AND TRADEMARK OFFICE

CERTIFICATE OF CORRECTION

PATENT NO. : 4,205,610

DATED : June 3, 1980

INVENTOR(S) : Daniel P. Zerga

It is certified that error appears in the above-identified patent and that said Letters Patent are hereby corrected as shown below:

Column 1, line 47, delete "changes" and insert ---charges---.

In the Claims:

Claim 5, Col. 6, line 37, after "from" insert

---said corner charges, and said third charges being positioned transversely opposite said inside charges and at substantially equal diagonal distances from---.

Signed and Sealed this

*Fourth* Day of *November 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,205,610

DATED : June 3, 1980

INVENTOR(S) : Daniel P. Zerga

It is certified that error appears in the above—identified patent and that said Letters Patent is hereby corrected as shown below:

Column 1, between lines 4 and 5, insert the following paragraph:

-- The Government has rights in this invention pursuant to Contract No. DE - FC20 - 78C10787 (formerly ET - 76- f - 03 - 1787) awarded by the U. S. Department of Energy. --.

Signed and Sealed this

Second Day of March 1982

[SEAL]

Attest:

GERALD J. MOSSINGHOFF

Attesting Officer

Commissioner of Patents and Trademarks